United States Patent [19]

Scherer et al.

[11] Patent Number: 4,685,621

[45] Date of Patent: Aug. 11, 1987

[54] ACCUMULATION RESISTANT TIP GUARD

[75] Inventors: William C. Scherer, Minneapolis; Jimmy W. Tam, Shoreview; Duane A. Luebeck, Blaine, all of Minn.

[73] Assignee: Graco, Inc., Minneapolis, Minn.

[21] Appl. No.: 843,068

[22] Filed: Mar. 24, 1986

[51] Int. Cl.[4] ..... B05B 1/28

[52] U.S. Cl. ..... 239/288; 239/DIG. 22

[58] Field of Search ..... 239/599, 288, 288.3, 239/288.5, 525–527, DIG. 22, DIG. 14, 104, 106, 119, 502, 504; 141/86, 115

[56] References Cited

U.S. PATENT DOCUMENTS

| | | | |
|---|---|---|---|
| 1,956,637 | 1/1934 | Biggs et al. | 239/122 |
| 3,599,876 | 8/1971 | Kyburg | 239/DIG. 22 X |
| 3,799,440 | 3/1974 | Goss et al. | 239/120 |
| 3,880,355 | 4/1975 | Larson et al. | 239/288.3 |
| 3,944,141 | 3/1976 | Siczek | 239/288.5 |
| 3,952,955 | 4/1976 | Clements | 239/288.5 |
| 3,963,180 | 6/1976 | Wagner | 239/288.5 |
| 4,025,045 | 5/1977 | Kubiak | 239/288.5 |
| 4,036,438 | 7/1977 | Soderlind et al. | 239/288.5 |
| 4,074,857 | 2/1978 | Calder | 239/119 |
| 4,116,386 | 9/1978 | Calder | 239/119 |
| 4,165,836 | 8/1979 | Eull | 239/119 |
| 4,181,261 | 1/1980 | Crum | 239/288.5 |
| 4,239,157 | 12/1980 | Fasth | 239/288.5 |
| 4,331,296 | 5/1982 | Levey | 239/288 |
| 4,331,299 | 5/1982 | Culbertson et al. | 239/691 |
| 4,424,761 | 1/1984 | Thorn et al. | 239/122 X |
| 4,483,481 | 11/1984 | Calder | 239/119 |
| 4,484,707 | 11/1984 | Calder | 239/119 |
| 4,489,893 | 12/1984 | Smead | 239/691 |
| 4,537,355 | 8/1985 | Calder | 239/119 |
| 4,560,109 | 12/1985 | Teruyuki et al. | 239/526 X |

FOREIGN PATENT DOCUMENTS

| | | | |
|---|---|---|---|
| 1114598 | 12/1981 | Canada | 239/288 |

*Primary Examiner*—Andres Kashnikow
*Assistant Examiner*—Kevin Patrick Weldon
*Attorney, Agent, or Firm*—Douglas B. Farrow

[57] ABSTRACT

A tip guard is provided for protecting an airless spray tip and preventing accumulation of paint on the tip guard. The tip guard has two pair of vanes extending forwardly and radially outwardly from a base, each a pair of vanes being joined by a crossbar. A pointed edge faces radially inwardly from each of the vanes and the crossbar and, generally, planar sides are provided to each plane, thereby allowing air flow through the side of the tip guard and preventing buildup of paint on the surface of the tip guard.

15 Claims, 6 Drawing Figures

ACCUMULATION RESISTANT TIP GUARD

BACKGROUND OF THE INVENTION

Airless spray guns have been known and used for many years. Such guns have always been somewhat hazardous due to the high pressures involved. Accidental injection of fluid is possible if the painter should place the spray tip too close to a body part. Approximately ten years ago, tip guards came into widespread use, typically providing a duck-bill shaped device which made it difficult for a person to get the tip much closer than approximately an inch to a body part. At such a distance, the danger of injection is substantially reduced or eliminated.

One problem with all the prior art tip guards, however, has been that such guards tend to accumulate paint during spraying. This has resulted in two problems. First of all, the spray may tend to build up a liquid film on the guard and then drip off the gun, thereby providing a messy situation and possibly dripping onto the floor or operator. In addition, paint can accumulate and be carried off the tip guard by the aerodynamic forces of the spray onto the painted surface, thereby causing splatters and other imperfections in the painted surface. As a result, many painters tend to remove the tip guard to solve these problems in spite of the increased safety hazard produced by doing so.

Also, as paint builds up on the tip guard surface, the operator will often use a rag to wipe the inner tip guard surface. If the gun is accidentally triggered while doing so, injection may result.

It is, therefore, an object to this invention to provide a tip guard which provides substantially the physical protection provided by prior art devices. It is further an object of this invention to provide a tip guard which tends to resist accumulation of paint during spraying, thereby removing the incentive for the painter to remove the tip guard. It goes without saying that the tip guard will not be effective unless it is left in place by those for whom its use is intended.

SUMMARY OF THE INVENTION

The tip guard of the instant invention is provided with a generally molded base which fits around the spray tip. Ideally, the base is of a construction such that it must be used in conjunction with the tip and cannot be easily removed.

Two pairs of vanes extend forwardly and radially outwardly from the base, each vane having a planar inner and a planar outer side which diverge away from one another at a sharp edge which faces radially inwardly toward the spray axis produced by the spray pattern. Each pair of vanes is joined by a crossbar which also has a sharp inwardly facing edge. Each crossbar has an upper and a lower surface which are also, generally, planar and which merge into the outer and inner surfaces, respectively of the vanes. It is generally important that the edge which faces the spray pattern be relatively sharp and that the sides which diverge away from the edge are generally flat in order to prevent buildup thereon.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
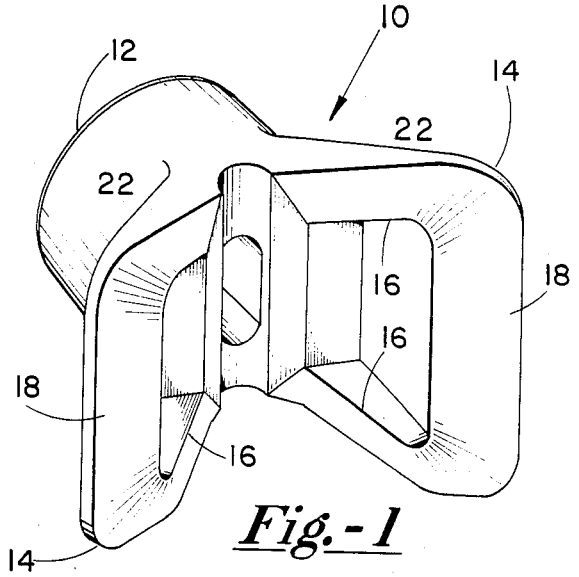
FIG. 1 is a perspective view of the instant invention.
Figure 2:
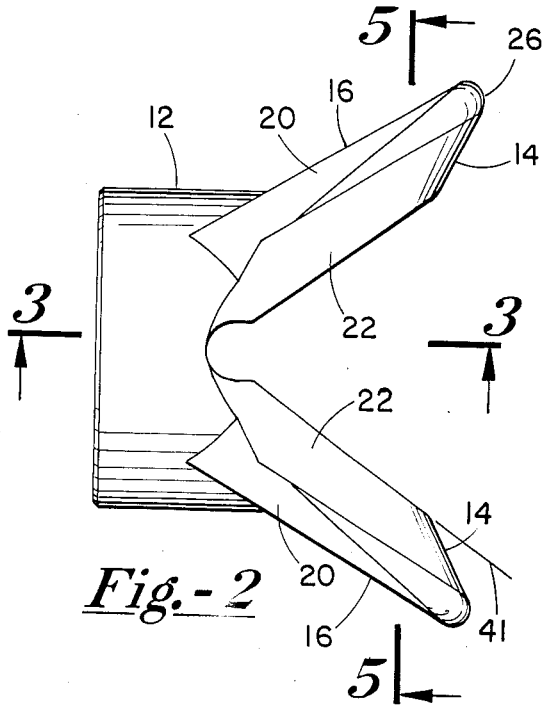
FIG. 2 is a side-plan view showing the tip guard of the instant invention.

The tip guard 10 of the instant invention is shown perspectively in FIG. 1. The tip guard is designed for attachment to the front end of an airless spray gun. Tip guard 10 is molded of a generally non-breakable material, such as a nylon, the term non-breakable meaning not easily broken manually by the painter off the gun. The method of attachment to the gun does not form part of the invention here, the methods of attachment being generally well-known in the art. A pair of wing members 14 extend generally forwardly and outwardly from base 12, each wing 14 being formed by a pair of vanes 16 and a crossbar 18. Both vanes 16 and crossbar 18 are generally v-shaped and cross sections will be more fully described hereinafter.

Figure 5:
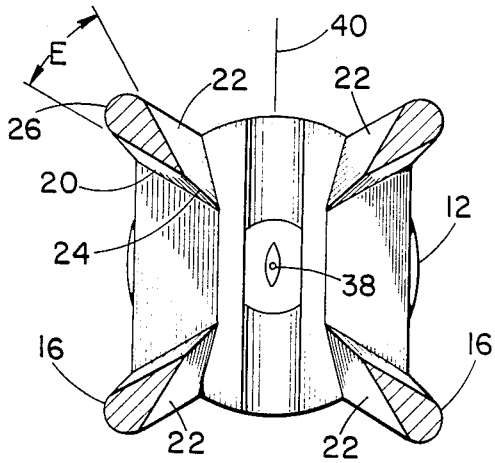
FIG. 5 is a sectional view taken along line 5—5 of FIG. 2.

As can be seen particularly in FIG. 5, each vane 16 is formed with an inner surface 20 and an outer surface 22 which diverge radially outwardly from a sharp inner edge 24. While a small radius can be acceptable on edge 24, it is preferable that this edge 24 be sharp in order to more effectively prevent the buildup and accumulation of paint. The rounded rear portion 26 is provided on the outer side of each vane 16. The angle formed by inner and outer sides 20 and 22, respectively, is shown in FIG. 5 as angle E, which in the preferred embodiment has a value of approximately 35°. In practice, this angle may vary between as much as 10° and 60° but, ideally, should be confined to the range between 30° and 40° for best results.

Figure 4:
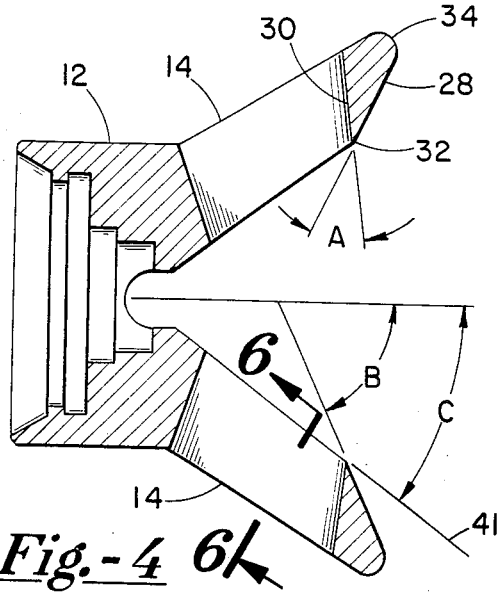
FIG. 4 is a sectional view taken along line 4—4 of FIG. 3.
Figure 3:
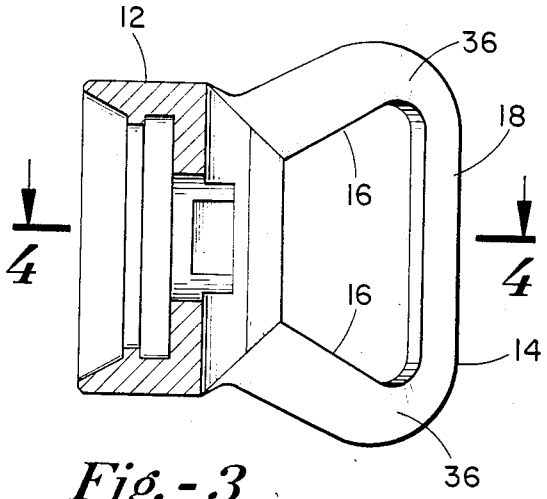
FIG. 3 is a sectional view taken along line 3—3 of FIG. 2.

Each crossbar 18, as shown in FIG. 4, is provided with an upper side 28 and a lower side 30 which diverge outwardly from an inner edge 32. A round outer surface 34 is also provided. As can be seen in FIG. 3, a rounded transition area 36 provides a junction between vanes 16 and crossbar 18.

Figure 6:
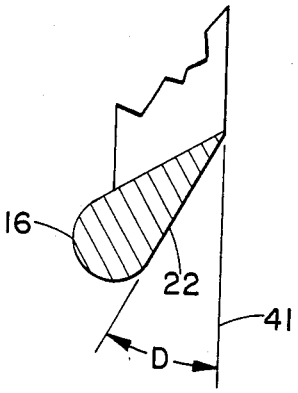
FIG. 6 is a sectional view taken along line 6—6 of FIG. 4.

Spray tip 38 is shown in FIG. 5 and is of a generally conventional cat's eye-shaped configuration. The cat's eye-shaped spray tip 38 throws a generally planar fan-shaped spray pattern which has a plane designated by line 40 extending generally out of the view shown in FIG. 5. Angle D, shown in FIG. 6, is the angle formed between the outer sides 22 and the plane 41 formed by inner edges 24 and 32. Angle D shows best results when having a value of between 30° and 60° and, ideally, a value of approximately 45°.

Crossbar 18 has an angle A formed between the upper and lower sides 28 and 30, respectively, angle A having a desired value of 35° and, ideally, lying between 30° and 40°. As can be seen in FIG. 4, crossbars 18 generally form a plane which is substantially normal to the spray pattern which extends to the right in FIG. 4. The generally flat face plane 41, formed by the inner edges 24 and 32, respectively, of vanes 16 and crossbar 18, forms an angle C with respect to the spray pattern, angle C having a value of 35° in the preferred embodiment. The upper side 28 of crossbar 18 forms an angle B with the plane of the spray pattern, angle B having a preferred value of approximately 65°. Ideally, the lower side 30 of crossbar 18 deviates only slightly from being normal to the spray pattern.

All known prior art tip guards have a construction such that the tip guards will accumulate paint to the point of dripping in under five minutes. The striking improvement provided by the tip guard of the instant invention allows spraying for literally hours at a time without objectionable buildup.

It is contemplated that various changes and modifications may be made to the tip guard without departing from the spirit and scope of the invention as defined by the following claims.

What is claimed is:

1. A tip guard for protection of an airless spray tip having a generally planar fan pattern with a spray axis, said tip guard comprising:

a base located adjacent said tip;

at least four vanes extending axially forwardly and radially outwardly from said base and forming at least first and second pairs, each said vane having a distal end, a substantially sharp inner edge facing radially inwardly toward said axis and inner and outer sides, said sides diverging outwardly from said inner edge; and at least two crossbars, each said crossbar joining a pair of said vanes at said distal end and each said crossbar having a substantially sharp inner edge facing inwardly toward said spray pattern said tip guard being formed of material and dimensions sufficient to resist breakage during normal use.

2. The tip guard of claim 1 wherein said inner and outer sides are substantially planar.

3. The tip guard of claim 2 wherein the vane angle formed by said inner and outer sides is between about 10° and 60°.

4. The tip guard of claim 3 wherein said vane angle is between about 30° and 40°.

5. The tip guard of claim 4 wherein said vane angle is approximately 35°.

6. The tip guard of claim 1 wherein said crossbars generally define a plane substantially normal to said spray pattern.

7. The tip guard of claim 6 wherein each said crossbar comprises upper and lower sides diverging outwardly from said inner edge.

8. The tip guard of claim 7 wherein said upper and lower sides are substantially planar.

9. The tip guard of claim 8 wherein the crossbar angle formed by said upper and lower sides is between about 30° and 40°.

10. The tip guard of claim 9 wherein said crossbar angle is approximately 35°.

11. The tip guard of claim 9 wherein the angle formed between said upper sides and said spray pattern plane is about 65°.

12. The tip guard of claim 9 wherein the angle formed between said outer sides and said spray pattern plane is between about 30° and 60°.

13. The tip guard of claim 9 wherein the inner edges of each said pair of vanes and corresponding crossbar substantially form a plane, said plane having an angle relative to said spray pattern plane of approximately 35°.

14. The tip guard of claim 9 wherein said lower sides are approximately normal to said spray pattern.

15. The tip guard of claim 1 wherein said tip guard is formed of a substantially non-breakable material.

* * * * *